US009139030B2

(12) United States Patent
Arakane et al.

(10) Patent No.: US 9,139,030 B2
(45) Date of Patent: Sep. 22, 2015

(54) CARRIAGE MOVING DEVICE, METHOD AND COMPUTER-READABLE RECORDING MEDIUM CONTAINING INSTRUCTIONS TO EXECUTE CARRIAGE MOVING METHOD

(71) Applicant: BROTHER KOGYO KABUSHIKI KAISHA, Nagoya-shi, Aichi-ken (JP)

(72) Inventors: Satoru Arakane, Aichi (JP); Atsushi Yamada, Ichinomiya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/495,092

(22) Filed: Sep. 24, 2014

(65) Prior Publication Data

US 2015/0091957 A1 Apr. 2, 2015

(30) Foreign Application Priority Data

Sep. 30, 2013 (JP) ..... 2013-205521

(51) Int. Cl.

| | |
|---|---|
| ***B41J 29/38*** | (2006.01) |
| ***B41J 29/393*** | (2006.01) |
| ***B41J 2/015*** | (2006.01) |
| ***B41J 25/34*** | (2006.01) |

(52) U.S. Cl.

CPC ..... *B41J 25/34* (2013.01)

(58) Field of Classification Search

USPC ..... 347/6, 9, 20, 19

See application file for complete search history.

(56) References Cited

U.S. PATENT DOCUMENTS

2004/0061878 A1* 4/2004 Vives et al. ..... 358/1.8
2011/0273504 A1* 11/2011 Boesten et al. ..... 347/14

FOREIGN PATENT DOCUMENTS

JP 2002-096519 A 4/2002
JP 2003145877 A * 5/2003

* cited by examiner

*Primary Examiner* — Jason Uhlenhake
(74) *Attorney, Agent, or Firm* — Merchant & Gould PC

(57) ABSTRACT

A carriage moving device has a motor, and a carriage. The carriage moves in a first direction when the motor rotates forwardly, while the carriage moves in a second direction which is opposite to the first direction when the motor rotates reversely. The carriage moving device further includes a facing object having a plurality of reflection ratios at a plurality of positions in the scanning direction. A first sensor unit has a light emitting unit configured to emit light to the facing object and a light receiving unit configured to receive light reflected by the facing object. A second sensor unit is configured to output a second signal in response to movement of the carriage. The controller notifies an error of the second sensor unit in response to a condition where a changing amount of the first signal in the reversing step exceeds a threshold amount and the controller cannot obtain the second signal.

18 Claims, 7 Drawing Sheets

CARRIAGE MOVING DEVICE, METHOD AND COMPUTER-READABLE RECORDING MEDIUM CONTAINING INSTRUCTIONS TO EXECUTE CARRIAGE MOVING METHOD

CROSS-REFERENCE TO RELATED APPLICATION

This application claims priority under 35 U.S.C. §119 from Japanese Patent Application No. 2013-205521 filed on Sep. 30, 2013. The entire subject matter of the application is incorporated herein by reference.

BACKGROUND

1. Technical Field

Aspects of the present disclosure relate to a carriage moving device, a carriage moving method and a computer-readable recording medium containing computer-executable instructions to execute the carriage moving method.

2. Conventional Art

Conventionally, an inkjet printer employing a carriage which is movable in a main scanning direction and a recording head mounted on the carriage has been known. Ink is ejected from the recording head while the carriage is moving in the main scanning direction. Typically, the carriage is moved by a motor and rotation of the motor is controlled based on a pulse signal which is output from an encoder unit as the carriage moves. With such a configuration, the carriage can be controlled to locate at a desired position accurately.

SUMMARY

It is generally known that, in a device employing a motor, an operation of the motor is checked when the device is powered ON in order to prevent an error due to runaway of the motor. Typically, in such a device, the carriage is moved in one direction to check the pulse signal of a linear encoder, and then the carriage is moved in an opposite direction to check the pulse signal.

However, according to the operation check described above, when the pulse signal cannot be verified, it is impossible for a user to determine whether the pulse signal cannot be verified due to a disorder of the motor or due to a disorder of the linear encoder.

In consideration of the above, aspects of the disclosure provide an improved carriage moving device or method which is configured to notify appropriate information regarding a cause for an error currently occurring from among a plurality of possible causes.

According to aspects of the disclosure, there is provided a carriage moving device, which has a motor, a carriage movable in a scanning direction, the carriage moving in a first direction along the scanning direction when the motor rotates forwardly, the carriage moving in a second direction which is opposite to the first direction when the motor rotates reversely, a facing object configured to face the carriage, the facing object having a plurality of reflection ratios at a plurality of positions in the scanning direction, a first sensor unit mounted on the carriage at a position where the first sensor unit faces the facing object, the first sensor unit having a light emitting unit configured to emit light to the facing object and a light receiving unit configured to receive light reflected by the facing object, the first sensor unit being configured to output a first signal corresponding to a light amount of the light received by the light receiving unit, a second sensor unit configured to output a second signal in response to movement of the carriage, and a controller. The controller is configured to execute a carriage moving process in which the controller controls the motor to forwardly rotate to move the carriage in the first direction, a reversing process in which the controller controls the motor to reversely rotate to move the carriage in the second direction with controlling the light emitting unit to emit light in response to a condition where a time period during which the second signal cannot be obtained during the carriage movement process, and a notification process in which the controller notifies an error of the second sensor unit in response to a condition where a changing amount of the first signal in the reversing step exceeds a threshold amount and the controller cannot obtain the second signal.

According to further aspects of the disclosure, there is provided a carriage moving method employed in a device having a carriage configured to be movable in a scanning direction, the carriage being moved by a motor. The method includes a carriage moving step of forwardly rotating the motor to move the carriage in a first direction along the scanning direction, a light emitting step of causing a first sensor unit mounted on the carriage to emit light toward a facing object which has different reflection ratios at different positions in the scanning direction when a second signal which is output from a second sensor unit in association with movement of the carriage in the carriage moving step cannot be obtained, a reversing step of reversely rotating the motor to move the carriage in a second direction which is opposite to the first direction in the light emitting step, and a notification step of notifying an error of the second sensor unit when a changing amount of a first signal from the first sensor unit representing a received amount of light emitted by the first sensor unit and reflected by the facing object exceeds a threshold amount and the second signal cannot be obtained.

According to aspects of the disclosure, there is provided a non-transitory computer readable storage device containing instructions which can be executed by a controller of a carriage moving device having a carriage configured to be moved by a motor in a scanning direction. The controller, when executing the instructions, causes the carriage moving device to execute a carriage moving step of forwardly rotating the motor to move the carriage in a first direction along the scanning direction, a light emitting step of causing a first sensor unit mounted on the carriage to emit light toward a facing object which has different reflection ratios at different positions in the scanning direction when a second signal which is output from a second sensor unit in association with movement of the carriage in the carriage moving step cannot be obtained, a reversing step of reversely rotating the motor to move the carriage in a second direction which is opposite to the first direction in the light emitting step, and a notification step of notifying an error of the second sensor unit when a changing amount of a first signal representing a received amount of light emitted by the first sensor unit and reflected by the facing object exceeds a threshold amount and the second signal cannot be obtained.

According to the above configurations, there will be provided an improved carriage moving device or method which is configured to notify appropriate information regarding a cause for an error currently occurring from among a plurality of possible causes.

BRIEF DESCRIPTION OF THE ACCOMPANYING DRAWINGS

DETAILED DESCRIPTION OF EMBODIMENT

Figure 1:
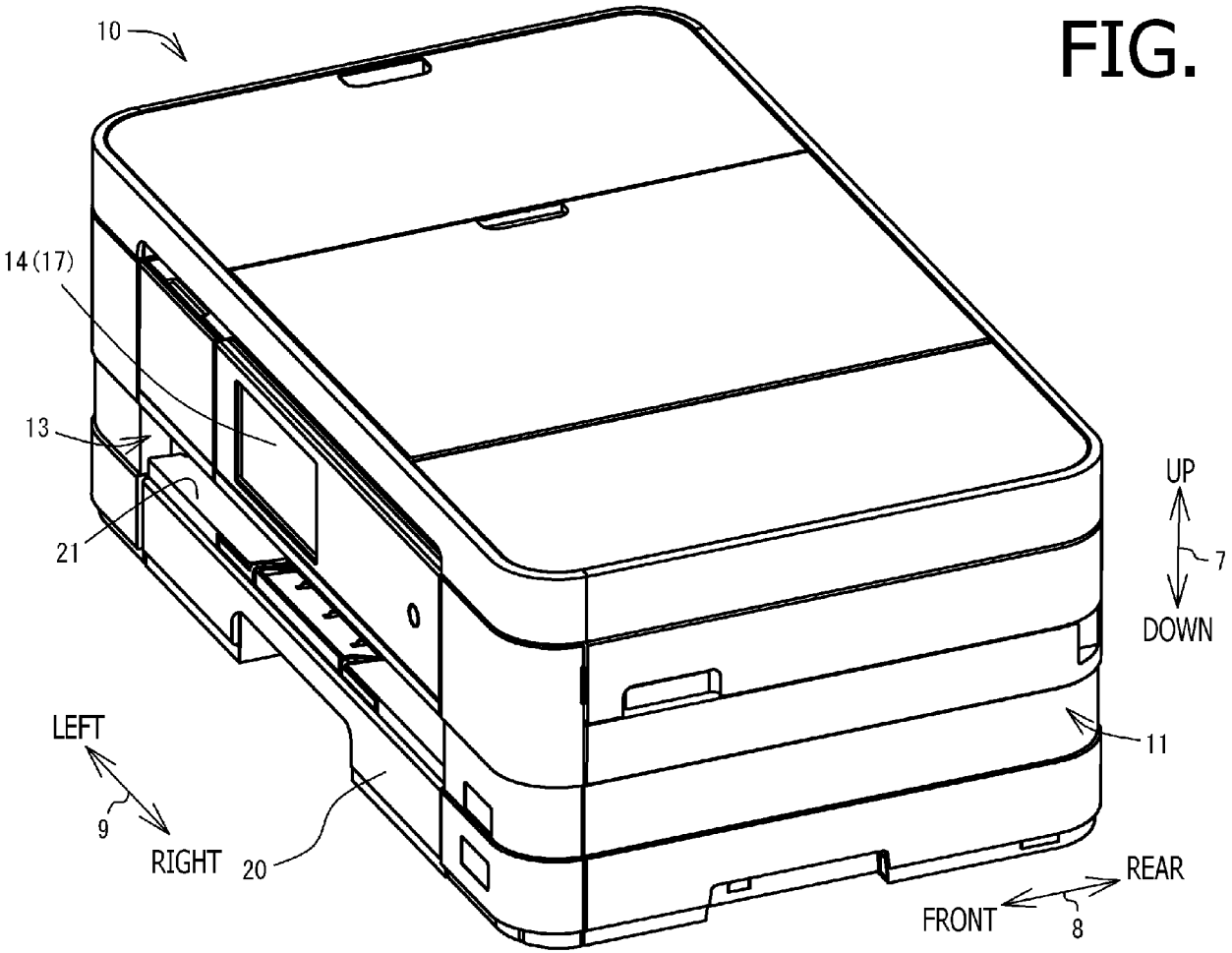
FIG. 1 is a perspective view of an MFP (multi-function peripheral) showing an appearance thereof according to an embodiment of the disclosure.

Hereinafter, referring to the accompanying drawings, an embodiment of the present disclosure will be described. It is noted that the embodiment described hereinafter is merely an exemplary embodiment, and the embodiment can be modified in various ways without departing from the scope of the present invention.

In the following description directions are described based on arrows indicated in the drawings. Specifically, an up-and-down direction 7 is defined based on a status where the MFP 10 is normally placed for use (i.e., a status shown in FIG. 1). Further, a side where an opening 13 is formed is referred to as a front side, and an front-and-rear direction 8 is defined. A right-and-left direction 9 is defined based on the right and left directions when the MFP 10 is viewed from the front direction.

The MFP 10 has a printer unit 11. The printer unit 11 is configured to record (print) images on recording sheets 12 (see FIG. 2) in accordance with an inkjet recording method.

The printer unit 11 has a sheet feeder 15, a sheet feed tray 20, a sheet discharge tray 21, a sheet conveying roller unit 54, a recording unit 24, a sheet discharge roller unit 55 and a platen 42.

The sheet feed tray 20 is configured to be inserted in and removed from the MFP 10 thorough the opening 13 formed on a front surface of the printer unit 11 (see FIG. 1) along the front-and-rear direction 8. The sheet feed tray 20 is capable of accommodating a plurality of recording sheets 12. The sheet discharge tray 21 is arranged above sheet feed tray 20. The sheet discharge tray 21 receives and supports the recording sheets 12 discharged by the discharge roller unit 55.

Figure 2:
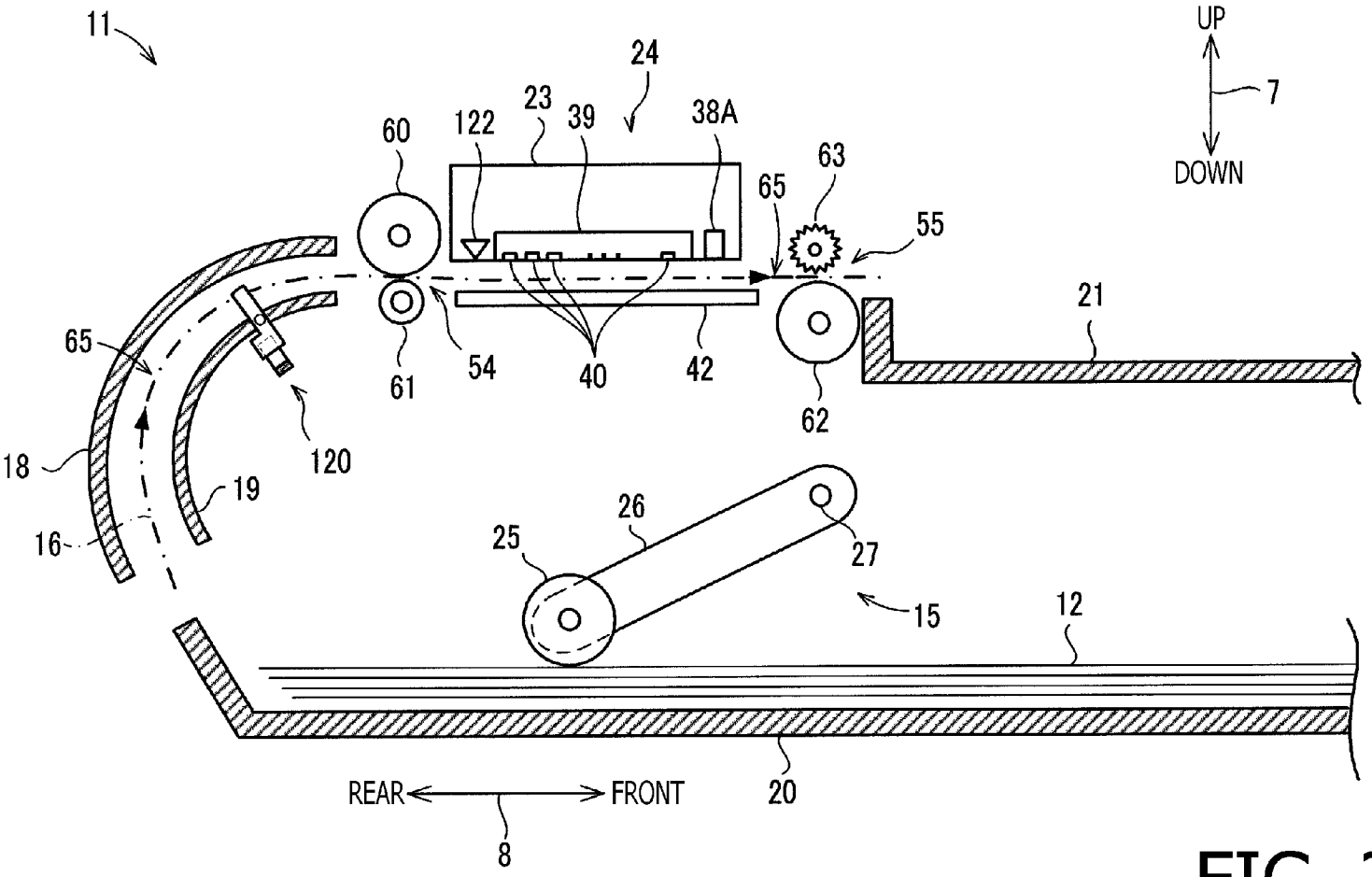
FIG. 2 is a cross-sectional view schematically showing inner structure of a printer unit of the MFP shown in FIG. 1.

The sheet feeder 15 has a feeding roller 25, a sheet feed arm 26 and a shaft 27 as shown in FIG. 2. The feeding roller 25 is rotatably supported at a distal end of the sheet feed arm 26. The feeding roller 25 rotates in a forward-rotation direction in which the recording sheet 12 on the sheet feed tray 20 is conveyed in a sheet conveyed direction 16 toward a sheet path 65 when a conveying motor 102 (see FIG. 4) reversely rotates. The sheet feed arm 26 is rotatably supported by the shaft 27 which is supported by a frame of the printer unit 11. The sheet feed arm 26 is rotatably urged toward the sheet feed tray 20 by an elastic force caused by its own weight and/or an urging member such as a spring.

The sheet path 65 is configured such that a part thereof is defined by an outer guide member 18 and an inner guide member 19 The sheet path 65 is a path extending from a rear end part of the sheet feed tray 20 to a position on a rear side of the sheet discharge tray 21. The path 65 extends from a lower rear position of the printer unit 11 to an upper position with making a U-turned path, then passes through the recording unit 24 and reaches the sheet discharge tray 21. In FIG. 2, a conveyed direction 16 of the recording sheet 12 in the sheet path 65 is indicated by a dotted line and arrow.

The conveying roller unit 54 is arranged on an upstream, in the sheet conveyed direction 16, with respect to the recording unit 24 (see FIG. 2). The conveying roller unit 54 has a conveying roller 60 and a pinch roller 61 which face each other. The conveying roller 60 is driven to rotate by the conveying motor 102. The recording sheet 12 is nipped between the conveying roller 60, which rotates in a forward direction as the conveying motor 102 forwardly rotates, and the pinch roller 61, and conveyed in the conveyed direction 16.

The discharge roller unit 55 is arranged at a downstream with respect to the recording unit 24 (see FIG. 2). The discharge roller unit 55 has a discharge roller 62 and a spur roller 63 which face each other. The discharge roller 62 is driven by the conveying motor 102 to rotate. The recording sheet 12 is nipped between the discharge roller 62, which rotates in a forward direction as the conveying motor 102 forwardly rotates, and the spur roller 63, and conveyed in the conveyed direction 16.

The printer unit 11 has a registration sensor 120 at an upstream, in the conveyed direction 16, with respect to the conveying roller unit 54. The registration sensor 120 is for detecting whether a recording sheet 12 is present/absent at a position where the registration sensor 120 is arranged. When a recording sheet 12 is located at the position where the registration sensor 120 is arranged, the registration sensor 120 transmits a detection signal of a low-level signal to a controller 130. When no recording sheet 12 is located at the position, the registration sensor 120 transmits a detection signal of a high-level signal to the controller 130.

Figure 4:
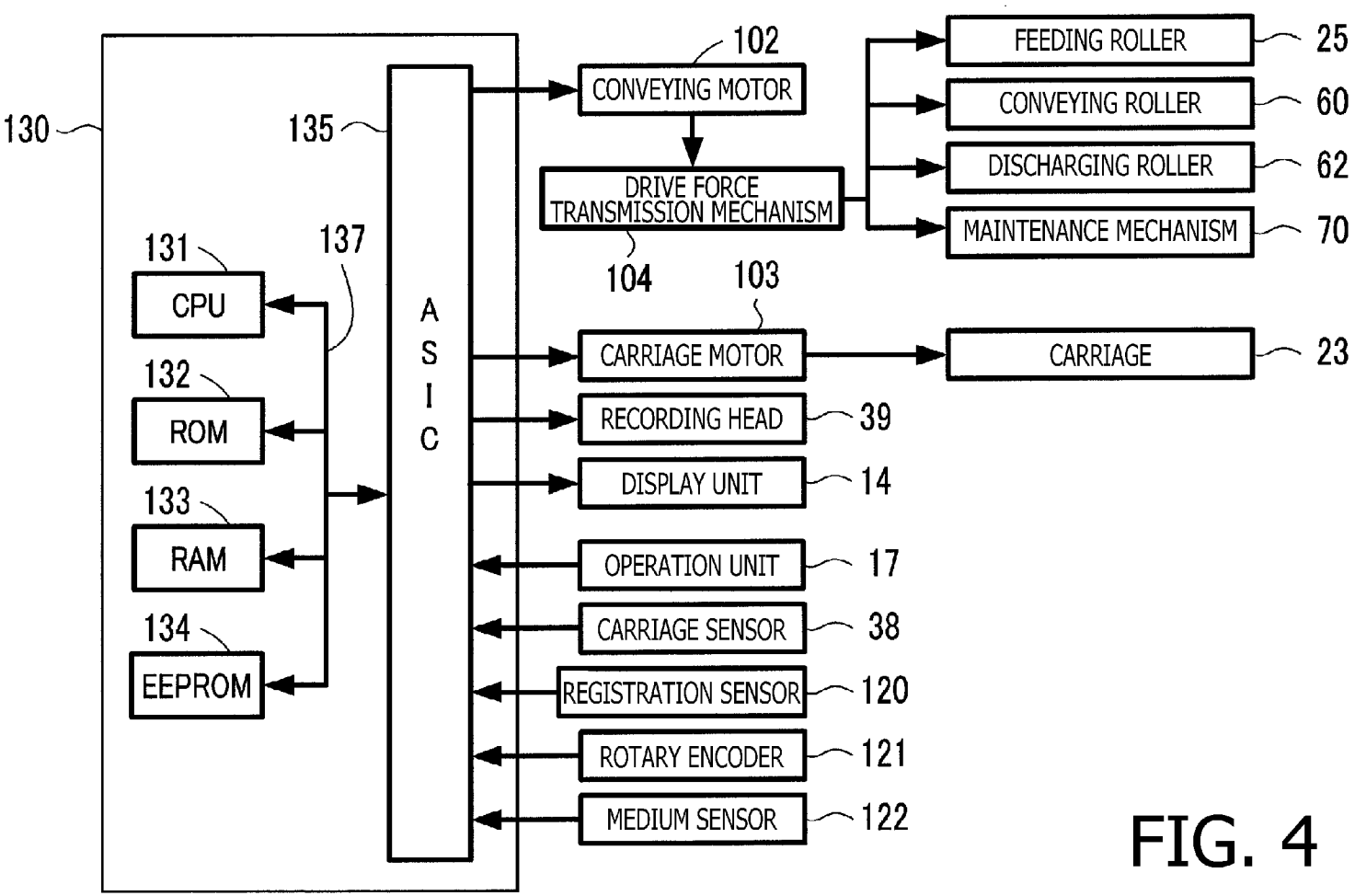
FIG. 4 is a block diagram of the printer unit of the MFP shown in FIG. 1.

The printer unit 11 has a well-known rotary encoder 121 which generates a pulse signal in accordance with rotation of the conveying roller 60 (in other words, a rotation of the conveying motor 102) as shown in FIG. 4. The rotary encoder 121 is of a well-known structure and has an encoder disk and an optical sensor. The encoder disk of the rotary encoder 121 rotates in association with a rotation of the conveying roller 60. The optical sensor of the rotary encoder 121 reads a pattern formed on the rotating encoder disk to generate a pulse signal, and transmits the thus generated pulse signal to the controller 130.

Figure 3:
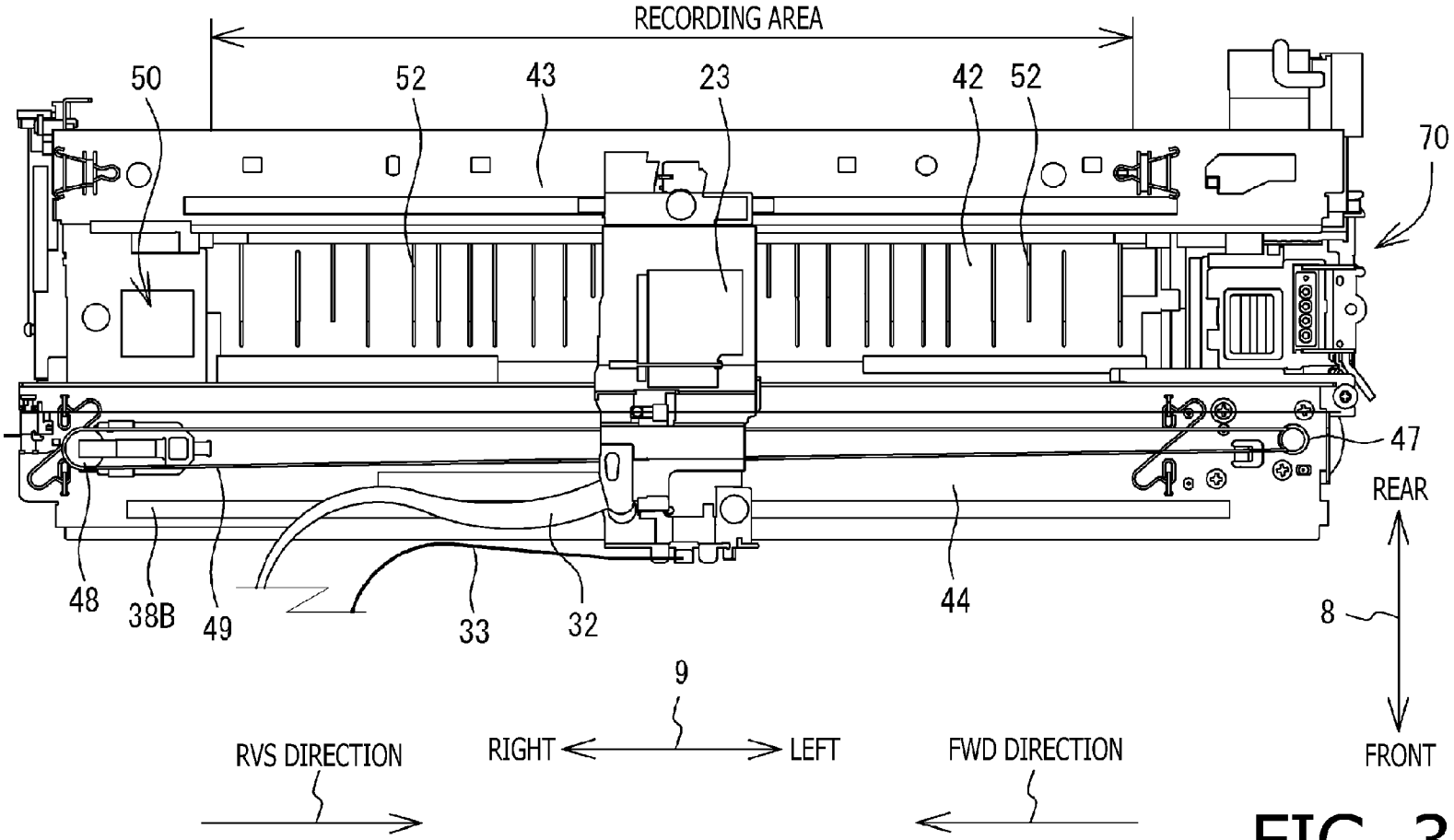
FIG. 3 is a plan view showing a carriage and guide rails according to embodiment of the disclosure.

The recoding unit 24 is arranged to face the platen 42 in the up-and-down direction 7. The recording unit 24 has a carriage 23, a recording head 39, an encoder sensor 38A and a medium sensor 122. From the carriage 23, an ink tube 32 and a flexible flat cable 33 are extended as shown in FIG. 3. The ink tube 32 is for supplying ink of the ink cartridge to the recording head 39. The flexible flat cable 33 connects a controller substrate implemented with the controller 130 with the recording head 39.

The carriage 23 is supported by guide rails 43 and 44 (see FIG. 3). The carriage 23 is connected to a well-known belt drive mechanism provided to the guide rail 44. The belt drive mechanism includes a driving pulley 47 provided to at one end, in the right-and-left direction 9, of the guide rail 44, a driven pulley 48 provided to the other end of the guide rail 44, and an endless belt 49 wound around the driving pulley 47 and the driven pulley 48.

The carriage 23 is connected to the belt 49. As the driving pulley 47, which is rotated by the driving force of a carriage motor 103 (see FIG. 4), moves the belt 49 to rotate, the carriage 23 makes a reciprocating movement in the right-and-left direction 9 (i.e., the scanning direction). Specifically, when the carriage motor 103 makes a forward rotation, the carriage 23 moves from right to left (i.e., FWD direction) in the right-and-left direction 9. When the carriage motor 103 makes a reverse rotation, the carriage 23 moves from left to right (i.e., RVS direction) in the right-and-left direction 9.

The recording head 39 is mounted on the carriage 23 (see FIG. 2). On a bottom surface of the recording head 39, a plurality of nozzles 40 are formed. The recording head 39 is configured such that the nozzles 40 eject small ink drops. Specifically, the recording head 39 ejects small ink drops through the plurality of nozzles 40 on to the recoding sheet 12 supported by the platen 42 while the carriage 23 is moving in the scanning direction, thereby an image is recorded on the recording sheet 12.

On the guide rail 44, an encoder strip 38B is provided. The encoder sensor 38A is mounted on the carriage 23. While the carriage 23 is moving, the encoder sensor 38A reads the encoder strip 38B and generates a pulse signal, and transmits the generated pulse signal to the controller 130. The encoder sensor 38A and the encoder strip 38B constitute a carriage sensor 38 (see FIG. 4).

The platen 42 is arranged between, in the sheet conveyed direction 16, the conveying roller unit 54 and the discharge roller unit 55 (see FIG. 2). The platen 42 is configured to support the recording sheet 12 conveyed by the sheet conveying roller unit 54 from the below. On the upper side of the platen 42, a plurality of supporting ribs 52 which protrude upward and extend along the front-and-rear direction 8 are formed (see FIG. 3). The plurality of ribs 52 are arranged in the right-and-left direction 9 at certain intervals.

Portions at which the supporting ribs 52 are formed and portions at which the supporting ribs 52 are not formed have different reflection ratios. That is, the platen 42 is formed such that portions having different reflection ratios are arranged alternately in the right-and-left direction 9. It is noted that the cause for the different reflection ratios is not limited to a particular structure. For example, the different reflection ratios may be realized since the height of the portions where the supporting ribs 52 are formed and the height of the portions at which the supporting ribs are not formed are different (i.e., distances to the medium sensor 122 are different). Alternatively, the color of the portions where the plurality of ribs are formed and the color of the portions where the plurality of ribs are not formed may have different colors.

The MFP 10 has a maintenance mechanism 70 as shown in FIG. 3. The maintenance mechanism 70 is arranged outside and on the right side of a recording range within which the carriage 23 reciprocates during image formation. It is noted that, within the recording range, the recording head 39 can face the recording sheet 12 placed on the platen 42. The maintenance mechanism 70 performs a purge process for removing ink, air bubbles and other foreign particles from the nozzles 40 of the recording head 39 with suctioning when the carriage 23 is located on the right side with respect to the recording range. It is noted that reflection ratio of the upper surface of the maintenance mechanism 70 is largely different from reflection ratio of the upper surface of the platen 42.

The MFP 10 has a waste ink tray 50 which is arranged in an area outside and on the left side of the recording range. In an inner space of the waste ink tray 50, an ink absorbing member is accommodated. Further, the waste ink tray 50 has an opening on an upper surface thereof facing the lower surface of the recording head 39, and is capable of receiving the ink discharged from the recording head 39 through the opening. The reflection ratio of the upper surface of the waste ink tray 50 is largely different from the reflection ratio of the upper surface of the platen 42. For example, on the upper surface of the waste ink tray 50, the ink absorbing member is exposed to outside through the opening. The ink absorbing member typically has a white color, and the platen 42 typically has a color (e.g., black) which has a lower reflection ratio than the white member.

The medium sensor 122 is mounted on a bottom surface (i.e., a surface facing the platen 42) of the carriage 23 as shown in FIG. 2. The medium sensor 122 has a light emitting unit having an LED (light emitting diode) and a light receiving unit having an optical sensor. The light emitting unit is configured to emit light, of which light amount is specified by the controller 130, to the platen 42, to the maintenance mechanism 70 or to the waste ink tray 50. The light emitted to the platen 42 is reflected by the platen 42, the maintenance mechanism 70 or the waste ink tray 50. The reflected light is received by the light receiving unit.

The medium sensor 122 transmits a detection signal corresponding to the amount of the light received by the light receiving unit to the controller 130. For example, the medium sensor 122 transmits a higher level detection signal when the light amount of the received light is greater. It is noted that, the light emitted by the light emitting unit during the movement of the carriage 23 will be reflected by the supporting ribs 52, positions of the platen 42 other than the portions of the ribs 52, the maintenance mechanism 70, and the waste ink tray 50 which have different reflection ratios. The light reflected by the above portions is received by the light receiving unit. That is, the level of the signal of the detection signal output by the medium sensor 122 varies during the movement of the carriage 23 in the scanning direction.

A driving force transmission mechanism 104 (see FIG. 4) is configured to transmits the driving force of the conveying motor 102 to the feeding roller 25, the conveying roller 60, the discharging roller 62 and the maintenance mechanism 70. The driving force transmission mechanism 104 may include all or part of gears, pulleys, an endless belt, a planetary gear mechanism (a pendulum gear mechanism) and a one way clutch mechanism.

A display unit 14 includes a display screen on which information to be notified to a user is displayed as messages and/or animations. The display unit 14 may have any type of well-known structure. For example, the display unit 14 may have an LCD (liquid crystal display), an organic EL (electro-luminescence) display and the like.

An operation unit 17 is an input interface used to acquire user input of operation instructions for the MFP 10. The operation unit 17 may have any type of well-known structure. For example, as shown in FIG. 1, the operation unit 17 may have a plurality of depression buttons. Alternatively or optionally, the operation unit 17 may have a touch panel overlaid on the display screen of the display unit 14.

The controller 130 has a CPU (central processing unit) 131, a ROM 132, a RAM 133, an EEPROM 134 and an ASIC 135, which are interconnected through an inner bus 137. The ROM 132 stores programs necessary for the CPU 131 to control various operations of the MFP 10. The RAM 133 is used as a storage area for temporarily storing data and signals when the CPU 131 executes various programs and/or a work area to be used for data processing. The EEPROM 134 stores settings and flags which are to be retained after the MFP 10 is powered OFF.

The ASIC 135 is connected to the conveying motor 102 and the carriage motor 103. The ASIC 135 obtains drive signals to rotate each of the conveying motor 102 and the carriage motor 103 from the CPU 131, and supplies driving currents corresponding to the obtained drive signals. Each of the conveying motor 102 and the carriage motor 103 rotates forwardly/reversely depending on the drive current supplied from the ASIC 135. The controller 130 may control driving of the conveying motor 102 to drive each of the feeding roller 25, conveying roller 60, and discharging roller 62. The controller 130 may control the drive of the carriage motor 103 to reciprocally move the carriage 23. Further, the controller 130 controls the recording head 39 to eject the ink through the nozzles 40.

Further, to the ASIC 135, the carriage sensor 38, the registration sensor 120, the rotary encoder 121 and the medium sensor 122 are connected. The controller 130 detects the location of the carriage 23 based on the pulse signal output by the carriage sensor 38. The controller 130 detects the location of the recording sheet 12 based on the detection signal output by the registration sensor 120 and the pulse signal output by the rotary encoder 121. Further, the controller 130 detects movement of the carriage 23 based on the detection signal output by the medium sensor 122.

Figure 5:
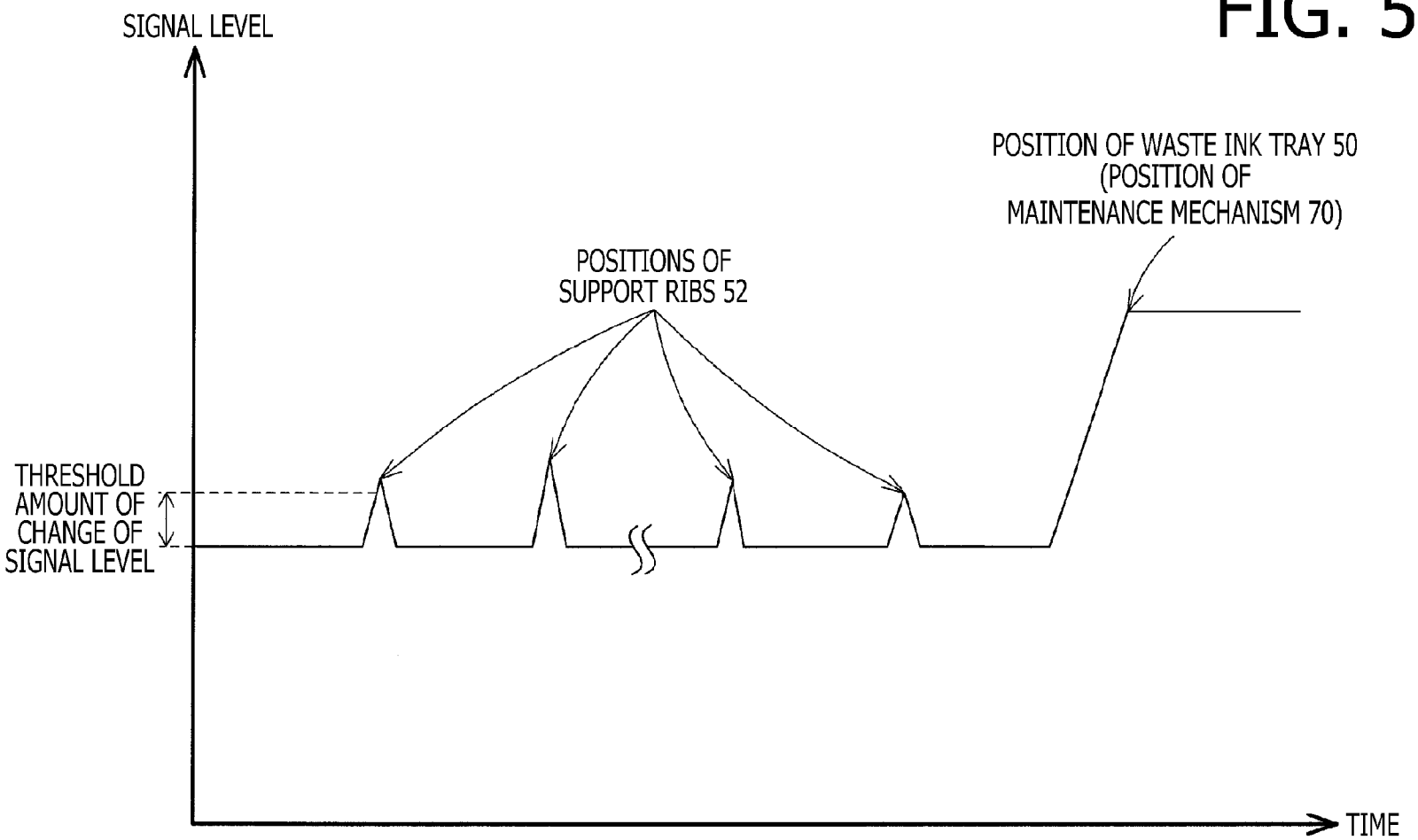
FIG. 5 is an exemplary graph showing a chronological variation of a detection signal which is output by a medium sensor during movement of the carriage.

Specifically, the controller 130 repeatedly obtains the detection signal output by the medium sensor 122 during the movement of the carriage 23 at every constant sampling period. FIG. 5 shows chronological change of the detection signal output by the medium sensor 122 and obtained by the controller 130 when the carriage 23 shown in FIG. 3 is moved in FWD direction (or RVS direction). As shown in FIG. 5, the detection signal output by the medium sensor 122 and obtained by the controller 130 varies in association with the moving time (which corresponds to a location) of the carriage 23.

In the example shown in FIG. 5, the level of the detection signal output by the medium sensor 122 when facing the supporting ribs 52 of the platen 42 is higher than that when the medium sensor 122 faces a portion on the platen 42 other than the ribs 52. Further, as shown in FIG. 5, the levels of the detection signals at positions corresponding to different ribs 52 may not be the same, but may vary. Further, the level of the detection signal output by the medium sensor 122 when facing the waste ink tray 50 (or the maintenance mechanism 70) is much higher than the detection signal of the medium sensor 122 when facing the platen 42. It is noted that the levels of the signals shown in FIG. 5 are only examples according to the embodiment, and aspects of the disclosure need not be limited to the depicted levels and/or relationship. For example, in another embodiment, the level of the detection signal corresponding to a portion on the platen 42 other than the supporting ribs 52 may be the highest, while the level of the detection signal corresponding to the waste ink tray 50 or the maintenance mechanism 70 may be the lowest.

According to the embodiment, the controller 130 detects that the carriage 23 is moving when the changing amount of the detection signals output by the medium sensor 122 and obtained by the controller 130 within a constant period (typically, continuously) exceeds a threshold amount of change of the signal levels. When the carriage 23 is not moving, the changing amount of the detection signal output by the medium sensor 122 is equal to or less than the threshold amount of change of the signal levels. It is noted that, the threshold amount may be set to an average changing amount of the signal level of the detection signal corresponding to the platen 42 at which the difference of the reflection ratios (i.e., difference between the reflection ratio at the supporting ribs 52 and the reflection ratio at a portion where the rib 52 is not provided) is the smallest.

Figure 6:
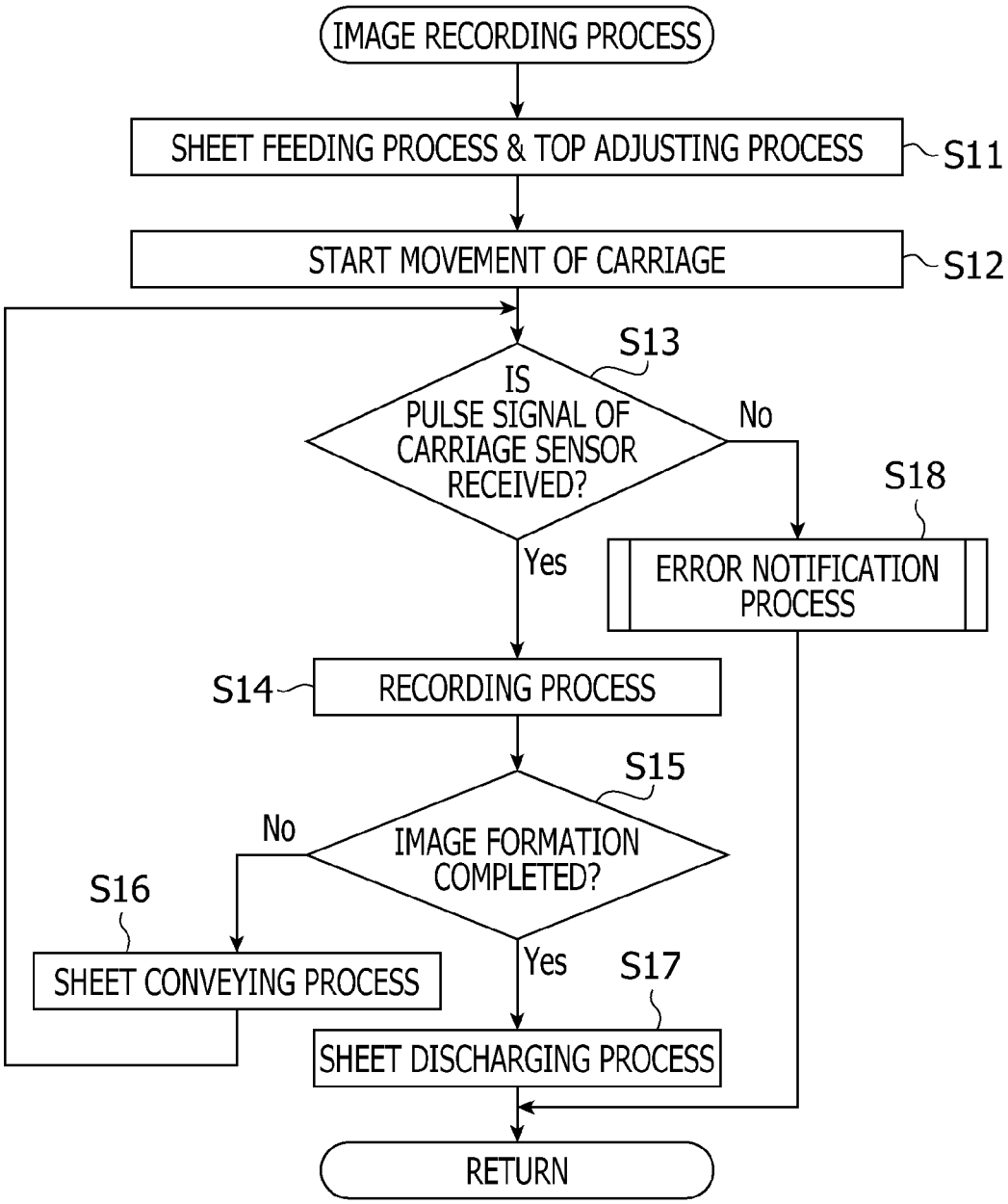
FIG. 6 is a flowchart illustrating an image recording process according to the embodiment of the disclosure.

FIG. 6 shows an image recording process executed by the CPU 131 of the controller 130. Processes described hereinafter may be executed such that the CPU 131 retrieves programs stored in the ROM 132 and/or hardware circuits implemented in the controller 130 may realize the processes. It is noted that the image recording process is described mainly referring to rotations of the feeding roller 25, the conveying roller 60 and the discharging roller 62 and/or movement of the carriage 23. These operations are realized by driving the conveying motor 102 and the carriage motor 103.

When the controller 130 obtains an instruction to start recording operation, the controller 130 executes the image recoding process shown in FIG. 6. The instruction to start image recording may be obtained from anywhere. For example, the controller 130 obtains the instruction through the operation unit 17 provided to the MFP 10. Alternatively or optionally, the controller 130 may obtains the instruction from an external device through a communication network. The controller 130 controls operations of each roller, the carriage 23 and the recording head 39 based on the obtained instructions to execute image recording on the recording sheet 12.

The controller 130 executes a sheet feeding process and a top adjusting process (S11). The sheet feeding process is to feed the recoding sheet 12 accommodated in the sheet tray 20 to the sheet path 65, and cause the leading end of the recording sheet 12 to reach the conveying roller unit 54. The top adjusting process is a process to convey the recording sheet 12 of which the leading end has reached the conveying roller unit 54 to a position at which an area of the recording sheet 12 on which an image is initially recorded faces the recording head 39.

The controller 130 controls the conveying motor 102 to reversely rotate so that the feeding roller 25 is forwardly rotated in the sheet feeding process. The controller 130 keeps the conveying motor 102 reversely rotating until the leading end of the recording sheet 12 located at the position where the registration sensor 120 is arranged reaches the conveying roller unit 54. It is noted that the position of the leading end of the recording sheet 12 is identified based on a combination of change of the signal output by the registration sensor 120 and the pulse signal output by the rotary encoder 121. Further, in the top adjusting process, the controller 130 controls the conveying motor 102 to forwardly rotate so that the conveying roller 60 and the discharging roller 62 forwardly rotate.

Next, the controller 130 starts moving the carriage 23 (S12). Specifically, the controller 130 supplies a driving current for moving the carriage 23 in the predetermined direction to the carriage motor 103. This step is a part of the recording process executed in S14. It is noted that the direction in which the carriage 23 is to be moved differs depending on the location of the carriage 23 when S12 is executed. The controller 130 stores the location of the carriage 23 and moving direction of the carriage 23 when S12 is executed in the RAM 133 or the like. According to the embodiment, the following description is made assuming that the carriage 23 is moved in the FWD direction when S12 is executed.

When the controller 130 obtains the pulse signal from the carriage sensor 38 (S13: YES), the controller 130 executes the recording process (S14). In the recording process, the controller 130 starts moving the carriage 23 in the FWD direction (the direction being determined based on the location of the carriage 23 when S12 is executed), and causes the recording head 39 to eject ink drops from the nozzles 40 when the carriage 23 is moving. With this control, in the area of the recording sheet 12 facing the recording head 39 with the top adjusting process, an image is recorded. It is noted that the location of the carriage 23 is identified based on the pulse signal output by the carriage sensor 38.

If an image has not been recorded on the recording sheet 12 (S15: NO), the controller 130 executes a conveying process (S16). The conveying process is a process to convey the recording sheet 12 by a predetermined amount (i.e., a line feed width) in the conveyed direction 16. Specifically, the controller 130 controls the conveying motor 102 to forwardly rotate so that the conveying roller unit 54 and the discharging roller unit 55 convey the recording sheet 12 by the predetermined line feed width in the conveyed direction 16.

The controller 130 repeatedly executes steps S12-S16 until image recording on the recording sheet 12 is judged to be finished (S15: YES). Optionally, in the recording process (S14), the controller 130 may control movement of the carriage 23 in the RVS direction and control the recording head 39 to eject ink drops from the nozzles during the movement of the carriage 23 in the RVS direction. When recording of the image on the recording sheet 12 is completed (S15: YES), the controller 130 executes the discharging process (S17) for discharging the recording sheet 12 on which the image has been recorded onto the discharge tray 21 (S17). Specifically, the controller 130 controls the conveying motor 102 to forwardly rotate until the recording sheet 12 is discharged on the discharge tray 21. Thereafter, the controller 130 finishes the image recording process.

If the controller 130 cannot obtain the pulse signal from the carriage sensor 38 (S13: NO), the controller 130 executes an error notification process (S18), and finishes the image recording process. There could be a plurality of error conditions in which the controller 130 cannot obtain the pulse signal from the carriage sensor 38. In the error notification process, the controller 130 identifies the error currently occurring from among the plurality of error conditions, and notifies the identified error condition to the user.

It is noted that, according to the embodiment, if the carriage sensor 38 operates normally, the pulse signal is output from the carriage sensor 38 within 50 msec after the carriage motor 103 is activated. Therefore, the controller 130 waits, by at least 50 msec, for output of the pulse signal from the carriage sensor 38. It is noted that the time period 50 msec is an exemplary threshold period, and according to another embodiment, different time period may be employed.

Hereinafter, with reference to FIG. 7, the error notification process will be described in detail. Firstly, the controller 130 executes a reversing process (S21). The reversing process is a process to supply electrical current for moving the carriage 23 in a direction opposite to the moving direction as S12 to the carriage motor 103. According to the embodiment, the controller 130 supplies electrical current for reversely rotating the carriage motor 103 (i.e., for moving the carriage 23 in the RVS direction) to the carriage motor 103. In the following description, the electrical current for reversely rotating the carriage motor 103 will be referred to as a first current. Further, the controller 130 controls the light emission unit of the medium sensor 122 to emit light. Thus, in the reversing process, the carriage 23 moves in the RVS direction with light emission from the medium sensor 122.

Next, in the reversing process (S21), if the changing amount of the detection signal output by the medium sensor 122 exceeds a threshold amount (S22: YES), and if the controller 130 can obtain the pulse signal from the carriage sensor 38 (S23: YES), the controller 130 notifies that there exists a foreign agent (typically, the jammed recording sheet 12) in the moving path of the carriage 23 (S24). It is noted that an error notified at S24 is determined based on a combination of the signals output from the medium sensor 122 and the carriage sensor 38. In S25, S27, S31, S32, S34 and S35, errors are determined and notified in a similar manner.

For example, when the movement of the carriage 23 in the FWD direction is prevented due to the foreign agent existing in the moving path thereof, while the movement in the RVS direction is allowed, S24 is executed. Concrete methods of notifying errors are not limited to any specific methods. For example, text messages or animations may be displayed on the display unit 14. Audio messages may be output with a speaker (not shown). Alternatively or optionally, notification may be made using a display unit or the like of an external device which is connected to the MFP 10 via a communication network.

If the changed amount of the detection signal output by the medium sensor 122 exceeds a threshold amount (S22: YES) and the controller 130 cannot obtain the pulse signal from the carriage sensor 38 (S23: NO), the controller 130 notifies an error of the carriage sensor 38 to the user (S25). Step S25 is executed, for example, when the carriage motor 103 operates normally but the carriage sensor 38 is unable to output the pulse signal. Specifically, such a condition may occur when the encoder sensor 38A does not operate normally, or the encoder strip 38B is dirtied by the ink or the like.

If the changing amount of the detection signal output by the medium sensor 122 is equal to or less than the threshold amount (S22: NO) and if the controller 130 can obtain the pulse signal from the carriage sensor 38 (S26: YES), the controller 130 notifies that a foreign agent (typically, the jammed recording sheet 12) may exist in the moving path of the carriage 23 (S27). S27 is similar to S24.

It is noted that a case where the changing amount of the detection signal output by the medium sensor 122 is equal to or less than the threshold amount when the carriage 23 moves in the RVS direction may be a case where the upper surface of the platen 42 is covered with the recording sheet 12. Alternatively, there could be a case where an error occurs on the medium sensor 122. Therefore, in S27, the controller 130 may further notify a possibility of an error of the medium sensor 122.

If the changing amount of the detection signal output by the medium sensor 122 is equal to or less than the threshold amount (S22: NO) and the controller 130 cannot obtain the pulse signal from the carriage sensor 38 (S26: NO), the controller 130 executes re-reversing process (S28).

Re-reversing process is a process to supply electrical current for moving the carriage 23 in a direction opposite to the moving direction on the reversing process (S21) to the carriage motor 103. According to the embodiment, the controller 130 supplies the electrical current (hereinafter, referred to as a second current) for controlling the carriage motor 103 to rotate forwardly (i.e., for moving the carriage 23 in the FWD direction) to the carriage motor 103. Further, the controller 130 causes the light emitting unit of the medium sensor 122 to emit light. That is, in the re-reversing process, the carriage 23 moves in the FWD direction with the medium sensor 122 emitting light.

If the changing amount of the detection signal output by the medium sensor 122 is equal to or less than a threshold amount (S29: NO) and the controller 130 cannot obtain the pulse signal from the carriage sensor 38 (S30: NO), the controller 130 notifies an error of the carriage motor 103 to the user (S31).

It is noted that S31 is executed when the movement of the carriage 23 cannot be detected even if the first current or second current is supplied to the carriage motor 103. Since each of the detection signals respectively output by the medium sensor 122 and the carriage sensor 38 indicates that the carriage 23 does not move, changes are low that an error is occurring in the sensors. Further, since the carriage 23 cannot move in the FWD direction or the RVS direction, the error is not due to the jammed recording sheet 12 but an error of the carriage motor 103.

If the changing amount of the detection signal output by the medium sensor 122 is equal to or less than the threshold amount (S29: NO) and the controller 130 can obtain the pulse signal from the carriage sensor 38 (S30: YES), the controller 130 notifies the user of errors due to other causes (S32). A case where S32 is executed may be a case where the pulse signal cannot be obtained when the carriage 23 is moved in the FWD direction in S12, but the pulse signal can be obtained from the carriage sensor 38 when the carriage 23 is moved in the FWD direction in S28 (i.e., S30: YES).

The above condition may occur, for example, when the movement of the carriage 23 is prevented due to unknown reason when S12 or S21 is executed, and the error is resolved when S28 is executed. If S32 is further executed, there is a possibility that an error occurs in the medium sensor 122. Therefore, the controller 130 may notify the user of occurrence of unknown error in S32, and further notifies the user of restarting of the MFP 10.

If the changing amount of the detection signal output by the medium sensor 122 exceeds the threshold amount (S29: YES) and the controller 130 cannot obtain the pulse signal from the carriage sensor 38 (S33: NO), the controller 130 notifies the user of an error condition of the carriage sensor 38 (S34). It is noted that S25 is similar to S34. A case where S34 is executed is a case, for example, the error notification process is executed with the carriage 23 facing the maintenance mechanism 70, the carriage 23 cannot move in the RVS direction any more in the reversing process (S21), and the carriage 23 can move in the FWD direction in the re-reversing process (S28).

If the changing amount of the detection signal output by the medium sensor 122 exceeds the threshold amount (S29: YES) and the controller 130 can obtain the pulse signal from the carriage sensor 38 (S33: YES), the controller 130 notifies the user of errors due to other causes (S35). It is noted that the process in S32 is substantially equal to S35.

According to the embodiment, depending on a combination of the signals respectively output by the carriage sensor 38 and the medium sensor 122, appropriate information regarding which of the carriage sensor 38 and the carriage motor 103 contains an error condition can be notified to the user. Therefore, even if an error occurs, quick restoration of the MFP 10 can be expected.

Figure 7:
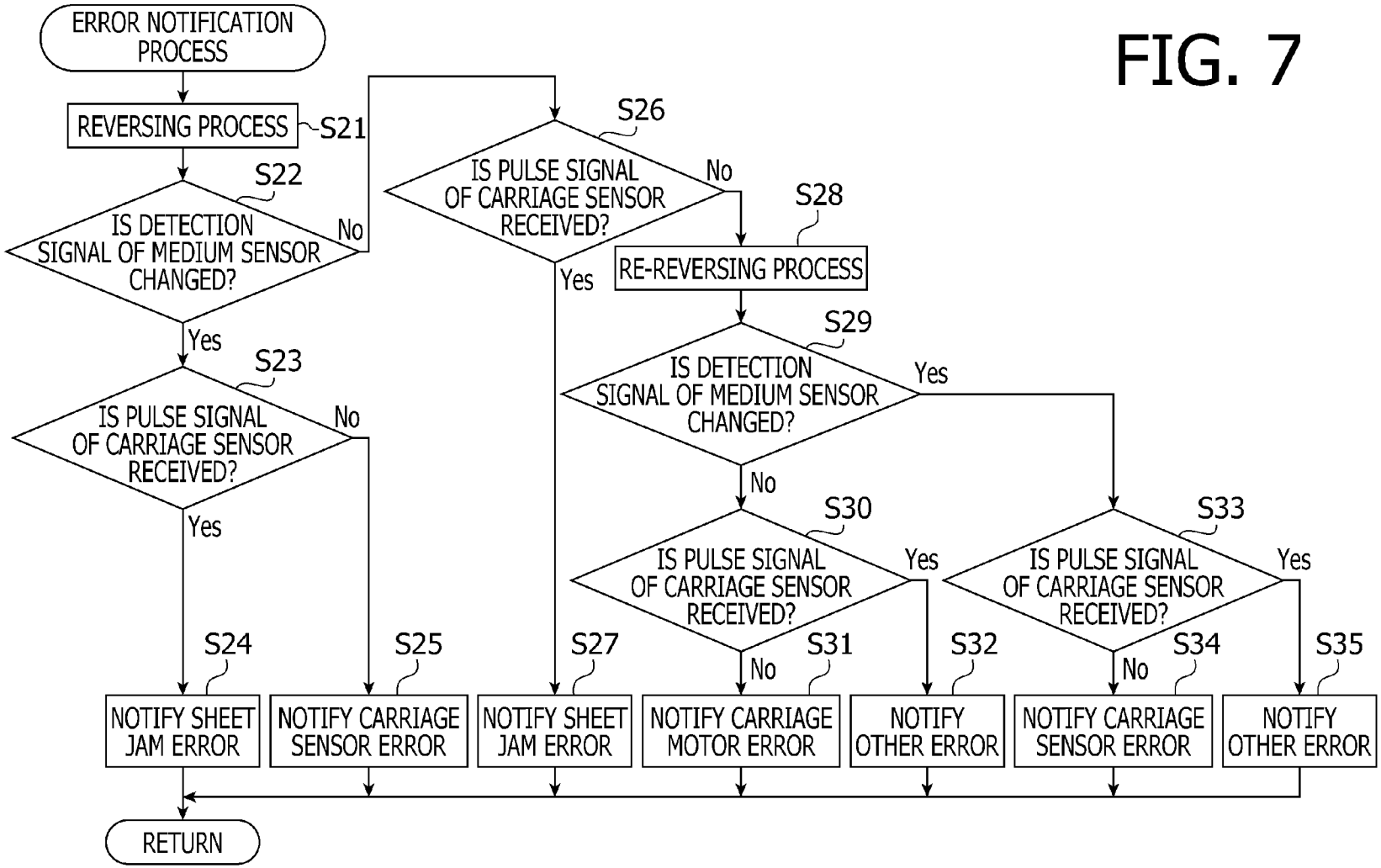
FIG. 7 is a flowchart illustrating an error notification process according to the embodiment of the disclosure.

In the error notification process shown in FIG. 7, process is diverged in accordance with all possible combinations of the signals output by the carriage sensor 38 and the medium sensor 122 (i.e., S22, S23, S26, S29, S30 and S33). The invention should not be limited to such a configuration. For example, S26 and S27 may be omitted. That is, the controller 130 may be configured to execute the re-reversing process (S28) if the changing amount of the detection signal output by the medium sensor 122 is equal to or less than the threshold amount (S22: NO).

For another example, steps S30 and S32 may be omitted. That is, the controller 130 may be configured to notify the user of the error of the carriage motor 103 (S31) if the changing amount of the detection signal output by the medium sensor 122 is equal to or less than the threshold amount (S29: NO). For another example, steps S33 and S35 may be omitted. That is, the controller 130 may notify the user of an error of the carriage sensor 38 (S34) if the changing amount of the detection signal output by the medium sensor 122 exceeds the threshold amount (S29: YES).

When the recording process (S14) shown in FIG. 6 is executed, the controller 130 may execute a feedback control in which the amount of the electrical current supplied to the carriage motor 103 is controlled based on a current location and destination of the carriage 23, and the pulse signal output by the carriage sensor 38. However, if the carriage sensor 38 cannot operate correctly, the feedback control cannot be executed. In such a case (e.g., when the reversing process or re-reversing process is executed), an open control may be executed, in which a constant amount of electrical current is applied to the carriage motor 103 by a constant period.

When the open control is executed, it is preferable that the moving amount of the carriage 23 in the reversing process (S21) or re-reversing process (S28) is the maximum moving amount of the carriage 23 (i.e., the distance between the right end to the left end of the guide rails 43 and 44). That is, the first current should be supplied to the carriage motor 103 during the period which is a necessary period for the carriage 23 being able to move from the left end to the right end of the guide rails 43 and 44 in the RVS direction. Further, the second current should be supplied to the carriage motor 103 during the period which is a necessary period for the carriage 23 being able to move from the right end to the left end of the guide rails 43 and 44 in the FWD direction.

Since the carriage 23 is moved by the maximum moving amount in the reversing process (S21) and the re-reversing process (S28), it is ensured that the carriage 23 is moved to the positions to face the waste ink tray 50 or the maintenance mechanism 70. As a result, the controller 130 can detect a large amount of change in the signal output by the medium sensor 122, and thus, it is ensured that the controller 130 detects that the carriage 23 has moved.

Further, the amplitude of the first current and the amplitude of the second current is set to small enough so that even if the carriage 23 has bumped the left end or right end of the guide rails 43 and 44 (i.e., further movement is prevented), the carriage 23 may not be broken. Therefore, even if the reversing process (S21) or the re-reversing process (S28) is executed when the carriage 23 is located at a position as shown in FIG. 3, breakage of the carriage 23 can be avoided.

In the exemplary embodiment above, the recoding process (S14) is described as an example of the carriage moving process. The invention should not be limited to such a configuration, and any process of moving the carriage 23 could be included in the carriage moving process. For example, a process of moving the carriage 23, in the RVS direction, to the position facing the maintenance mechanism 70 to apply the purge process to the recording head 39 may be included in the carriage moving process. The error notification process shown in FIG. 7 can be executed in any carriage moving process when the pulse signal cannot be obtained from the carriage sensor 38.

In the embodiment, the error notification process shown in FIG. 7 is executed when the controller 130 cannot obtain the pulse signal of the carriage sensor 38 (S13: NO) in the image recording process shown in FIG. 6. The invention should not be limited to such a configuration. For example, the controller 130 may execute an error inspection process in an inspection process of the MFP 10. That is, the movement of the carriage 23 to be executed before the error inspection process may only be the movement of the carriage 23 for inspection of the MFP 10, but not for the image recording process or the purge process.

The error inspection process may include S12, S13 and S18 shown in FIG. 6. That is, the controller 130 finishes the error inspection process if the carriage 23 is moved (S12) and the pulse signal can be obtained from the carriage sensor 38 (S13: YES). If the controller 130 cannot obtain the pulse signal from the carriage sensor 38 (S13: NO) after the controller 130 started the carriage 23 to move (S12), the controller 130 executes the error notification process (S18). It is noted that the inspection process may be performed when the MFP 10 is made, or when a service person fixes the MFP 10.

In the exemplary embodiment, the MFP 10 having the inkjet printer 11, which is an example of the carriage moving device, is described. The invention should not be limited to such a configuration, and the invention can be applied to any other appropriate devices such as a document feeder which conveys and reads a document sheet in an image scanning device.

What is claimed is:

1. A carriage moving device, comprising:

a motor;

a carriage movable in a scanning direction, the carriage moving in a first direction along the scanning direction when the motor rotates forwardly, the carriage moving in a second direction which is opposite to the first direction when the motor rotates reversely;

a facing object configured to face the carriage, the facing object having a plurality of reflection ratios at a plurality of positions in the scanning direction;

a first sensor unit mounted on the carriage at a position where the first sensor unit faces the facing object, the first sensor unit having a light emitting unit configured to emit light to the facing object and a light receiving unit configured to receive light reflected by the facing object, the first sensor unit being configured to output a first signal corresponding to a light amount of the light received by the light receiving unit; and a second sensor unit configured to output a second signal in response to movement of the carriage;

a controller, which is configured to execute:

a carriage moving process in which the controller controls the motor to forwardly rotate to move the carriage in the first direction;

a reversing process in which the controller controls the motor to reversely rotate to move the carriage in the second direction with controlling the light emitting unit to emit light in response to a condition where a time period during which the second signal cannot be obtained during the carriage movement process; and a notification process in which the controller notifies an error of the second sensor unit in response to a condition where a changing amount of the first signal in the reversing step exceeds a threshold amount and the controller cannot obtain the second signal.

2. The carriage moving device according to claim 1, wherein the controller executes:

a re-reversing process in which the controller controls the motor to forwardly rotate to move the carriage in the first direction with controlling the light emitting unit to emit light if the changing amount of the first signal is equal to or less than the threshold amount and the controller cannot obtain the second signal in during the reversing process; and notifying an error of the motor in the notification process if the changing amount of the first signal is equal to or less than the threshold amount and the controller cannot obtain the second signal during the re-reversing process.

3. The carriage moving device according to claim 2, wherein the controller notifies an error of the second sensor unit if the changing amount of the first signal exceeds the threshold amount and the controller cannot obtain the second signal during the re-reversing process.

4. The carriage moving device according to claim 2, wherein the controller:

supplies a first electrical current to the motor to move the carriage in the second direction in the reversing process; and supplies a second electrical current to the motor to move the carriage in the first direction in the re-reversing process.

5. The carriage moving device according to claim 2, wherein the controller controls the motor to rotate for a time period corresponding to move the carriage by a distance longer than a movable range of the carriage in the scanning direction during the reversing process and the re-reversing process.

6. The carriage moving device according to claim 1, wherein the controller notifies that a foreign object exists on a moving path of the carriage in the notification process if the changing amount of the first signal exceeds the threshold amount and the controller obtains the second signal during the reversing process.

7. The carriage moving device according to claim 1, wherein the controller notifies that a foreign object exists on the moving path of the carriage in the notification process if the changing amount of the first signal is equal to or less than the threshold amount and the controller obtains the second signal during the reversing process.

8. The carriage moving device according to claim 1, wherein the controller is configured to supply a constant amplitude of the first current to the motor for a constant period of time in the reversing process; and wherein the controller is configured to supply a constant amplitude of the second current to the motor for a constant period of time in the re-reversing process.

9. The carriage moving device according to claim 1, wherein the carriage mounts a recording head configured to eject ink drops to form an image.

10. A carriage moving method employed in a device having a carriage configured to be movable in a scanning direction, the carriage being moved by a motor, comprising:

a carriage moving step of forwardly rotating the motor to move the carriage in a first direction along the scanning direction;

a light emitting step of causing a first sensor unit mounted on the carriage to emit light toward a facing object which has different reflection ratios at different positions in the scanning direction when a second signal which is output from a second sensor unit in association with movement of the carriage in the carriage moving step cannot be obtained;

a reversing step of reversely rotating the motor to move the carriage in a second direction which is opposite to the first direction in the light emitting step; and a notification step of notifying an error of the second sensor unit when a changing amount of a first signal from the first sensor unit representing a received amount of light emitted by the first sensor unit and reflected by the facing object exceeds a threshold amount and the second signal cannot be obtained.

11. The carriage moving method according to claim 10, further comprising a re-reversing step of forwardly rotating the motor to move the carriage in the first direction with causing the light emitting unit to emit light when the changing amount of the first signal is equal to or less than a threshold amount and the second signal cannot be obtained during the reversing step, wherein the notifying step notifies an error of the motor when the changing amount of the first signal is equal to or less than the threshold amount and the second signal cannot be obtained during the re-reversing step.

12. The carriage moving method according to claim 11, wherein the notifying step includes notifying an error of the second sensor unit when the changing amount of the first signal exceeds the threshold amount and the second signal cannot be obtained during the re-reversing step.

13. The carriage moving method according to claim 11, wherein:

the reversing step supplies a first current to the motor to move the carriage in the second direction; and the re-reversing step supplies a second current to the motor to move the carriage in the first direction.

14. The carriage moving method according to claim 11, wherein each of the reversing step and the re-reversing step includes rotating the motor for a time period corresponding to move the carriage by a distance longer than a movable range of the carriage in the scanning direction.

15. The carriage moving method according to claim 10, wherein the notification step includes notifying that a foreign object exists on a moving path of the carriage when the changing amount of the first signal exceeds the threshold amount and the second signal cannot be obtained during the reversing step.

16. The carriage moving method according to claim 10, wherein the notification step includes notifying that a foreign object exists on the moving path of the carriage when the changing amount of the first signal is equal to or less than the threshold amount and the second signal is obtained during the reversing step.

17. The carriage moving method according to claim 10, wherein the reversing step includes supplying a constant amplitude of the reversing current to the motor for a constant period of time; and wherein the re-reversing step includes supplying a constant amplitude of the re-reversing current to the motor for a constant period of time.

18. A non-transitory computer readable storage device containing instructions which can be executed by a controller of a carriage moving device having a carriage configured to be moved by a motor in a scanning direction, the controller, when executing the instructions, causing the carriage moving device to execute:

a carriage moving step of forwardly rotating the motor to move the carriage in a first direction along the scanning direction;

a light emitting step of causing a first sensor unit mounted on the carriage to emit light toward a facing object which has different reflection ratios at different positions in the scanning direction when a second signal which is output from a second sensor unit in association with movement of the carriage in the carriage moving step cannot be obtained;

a reversing step of reversely rotating the motor to move the carriage in a second direction which is opposite to the first direction in the light emitting step; and a notification step of notifying an error of the second sensor unit when a changing amount of a first signal representing a received amount of light emitted by the first sensor unit and reflected by the facing object exceeds a threshold amount and the second signal cannot be obtained.

* * * * *